US009783391B2

(12) United States Patent
Zerelles et al.

(10) Patent No.: US 9,783,391 B2
(45) Date of Patent: Oct. 10, 2017

(54) ELEVATOR INSTALLATION

(71) Applicant: ThyssenKrupp Elevator AG, Essen (DE)

(72) Inventors: Holger Zerelles, Leinfelden-Echterdingen (DE); Bernd Altenburger, Neuhausen (DE); Ronald Dietze, Leinfelden-Echterndingen (DE); Juri Schäfer, Stuttgart (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 15/026,224

(22) PCT Filed: Sep. 30, 2014

(86) PCT No.: PCT/EP2014/002652

§ 371 (c)(1),
(2) Date: Mar. 30, 2016

(87) PCT Pub. No.: WO2015/043766

PCT Pub. Date: Apr. 2, 2015

(65) Prior Publication Data

US 2016/0244299 A1 Aug. 25, 2016

(30) Foreign Application Priority Data

Sep. 30, 2013 (DE) ..... 10 2013 110 790

(51) Int. Cl.
*B66B 9/00* (2006.01)
*B66B 11/08* (2006.01)
(Continued)

(52) U.S. Cl.
CPC ..... *B66B 11/022* (2013.01); *B66B 9/00* (2013.01); *B66B 2009/006* (2013.01); *B66B 2201/306* (2013.01)

(58) Field of Classification Search
CPC ..... B66B 2009/006; B66B 11/0095; B66B 5/0018; B66B 5/031; B66B 11/022; B66B 2201/306; B66B 9/00
See application file for complete search history.

(56) References Cited

U.S. PATENT DOCUMENTS 1,805,227 A * 5/1931 Rugg ..... B66B 5/0031 187/249
5,907,136 A * 5/1999 Hongo ..... B66B 1/42 187/249
(Continued)

FOREIGN PATENT DOCUMENTS

EP 2692676 A1 2/2014
KR WO 0030967 A1 * 6/2000 ..... B66B 1/42
(Continued)

OTHER PUBLICATIONS

German language International Search Report for International patent application No. PCT/EP2014/002652; dated Jan. 8, 2015.
(Continued)

*Primary Examiner* — Michael Mansen
*Assistant Examiner* — Stefan Kruer
(74) *Attorney, Agent, or Firm* — thyssenkrupp North America, Inc.

(57) ABSTRACT

An elevator installation includes a shaft in which at least two elevator cars are arranged one above the other and are capable of travel upward and downward in a vertical direction separately from one another, wherein each elevator car is assigned a travel drive. The elevator cars are capable of travel with large and small spacings to one another without the risk of collision by coupling at least two elevator cars together by way of a variable-length, releasable coupling device, wherein the spacing between the coupled-together elevator cars can be varied, in a manner dependent on the
(Continued)

relative speed between the two elevator cars, with the aid of at least one of the travel drives.

18 Claims, 4 Drawing Sheets

(51) Int. Cl.
*B66B 11/02* (2006.01)
*B66B 1/40* (2006.01)

(56) References Cited

U.S. PATENT DOCUMENTS 6,336,522 B1 * 1/2002 Fujita ..... B66B 1/42 187/293
8,069,954 B2 * 12/2011 Kempf ..... B66F 13/005 187/250
2004/0238287 A1 12/2004 Fujita et al.
2005/0217941 A1 * 10/2005 Strebel ..... B66B 1/40 187/249
2005/0279584 A1 12/2005 Reuter et al.
2006/0163006 A1 * 7/2006 Strebel ..... B66B 1/42 187/249
2008/0006485 A1 1/2008 Kocher et al.

FOREIGN PATENT DOCUMENTS

WO 2004/048243 A1 6/2004
WO 2012/131755 A1 10/2012

OTHER PUBLICATIONS

English translation of International Search Report for International patent application No. PCT/EP2014/002652; dated Jan. 8, 2015.
German language Written Opinion of the International Search Authority for International patent application No. PCT/EP2014/002652; dated Jan. 8, 2015.

* cited by examiner

ELEVATOR INSTALLATION

CROSS REFERENCE TO RELATED APPLICATIONS

This application is a U.S. National Stage Entry of International Patent Application Serial Number PCT/EP2014/002652, filed Sep. 30, 2014, which claims priority to German patent application no. 102013110790.7, filed Sep. 30, 2013.

FIELD

The invention relates to an elevator installation having a shaft in which at least two elevator cars are arranged one above the other and are capable of travel upward and downward in a vertical direction separately from one another, wherein each elevator car is assigned a travel drive for the traveling movement of the elevator car.

BACKGROUND

In order to convey a large number of persons by way of an elevator installation within a short time, it is known from the international laid-open specification WO 2004/048243 A1 for at least two elevator cars to be arranged in one shaft, and for said elevator cars to travel vertically upward and downward along a common traveling path separately from one another. Each elevator car is assigned a travel drive, which can impart the traveling movement of the elevator car.

To achieve a high level of transport capacity, it is advantageous if a passenger outside the shaft can, by way of a control device of the elevator installation, input a destination call indicating his or her travel destination. The control device can then perform an allocation assessment for each of the elevator cars and can assign the destination call to the elevator car with the best allocation assessment.

The elevator cars normally have an intentional safety spacing which ensures that, when two elevator cars are traveling one behind the other, the elevator car at the rear in the direction of travel can be reliably braked without the risk of a collision even if the elevator car at the front in the direction of travel brakes abruptly in the event of a fault.

Elevator installations are also known in which two elevator cars arranged one above the other are permanently connected to one another and simultaneously call at two mutually directly adjacent floors. The two elevator cars are driven by a common travel drive and form a so-called double-decker elevator.

To be able to adapt the spacing of the two elevator cars of a double-decker elevator to different spacings between floors, double-decker elevators of cumbersome construction are known in which the two elevator cars are held movably in a common frame and can be offset relative to one another in a vertical direction by way of an additional drive unit, such that the vertical spacing between the elevator cars can be adapted to the spacings between adjacent floors.

Double-decker elevators are suitable in particular for shuttle transport between two directly adjacent starting floors and two fixedly predefined, mutually directly adjacent destination floors. Double-decker elevators exhibit only limited suitability for travel between individually selectable starting and destination floors, because the imperative need for the two elevator cars to stop at mutually directly adjacent floors restricts the transport capacity.

Accordingly, there is a need for an elevator installation of the type discussed above that has a simple construction and permits the elevator cars to travel with large and small spacings between one another without the risk of collision.

BRIEF DESCRIPTION OF THE DRAWINGS

The present disclosure is described in detail below with reference to the attached drawing figures, wherein.

DETAILED DESCRIPTION

Figure 1:
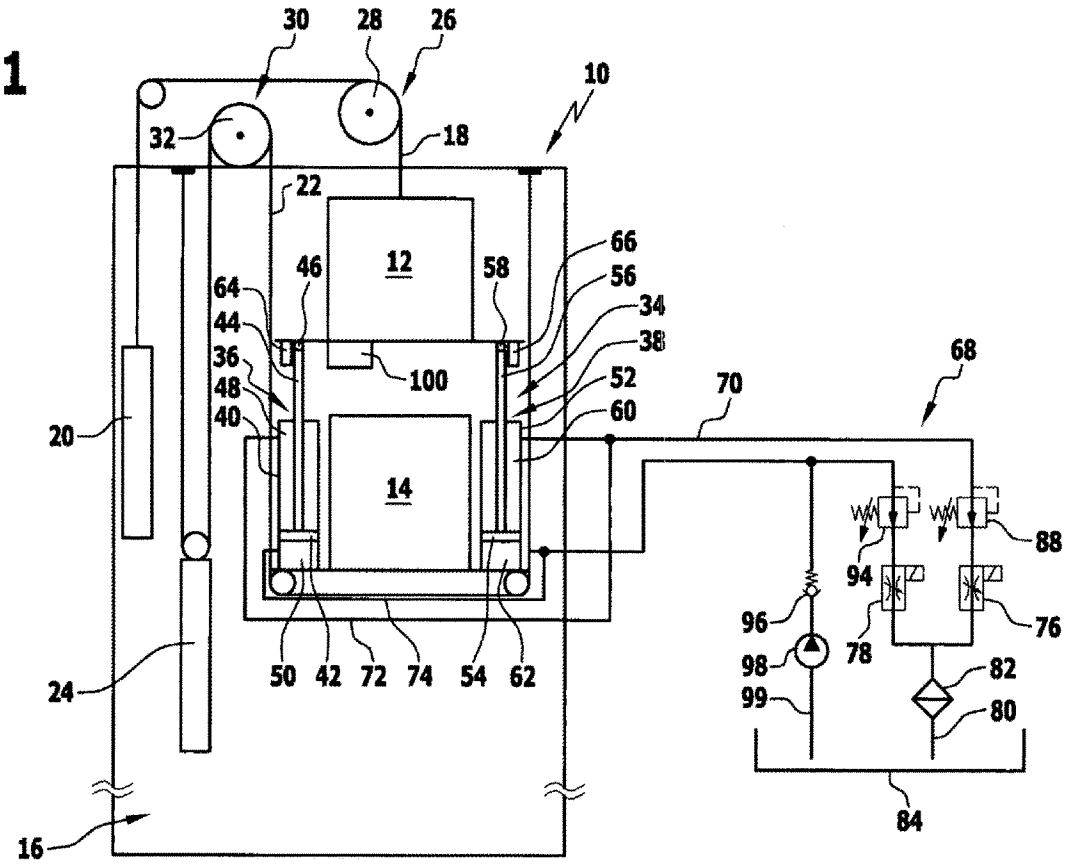
FIG. 1 is a schematic front view of an embodiment of an elevator installation of the present disclosure.

An elevator installation of the present disclosure comprises at least two elevator cars configured to be coupled together by way of a variable-length, releasable coupling device, wherein the spacing between the coupled-together elevator cars can be varied, in a manner dependent on the relative speed between the two elevator cars, with the aid of at least one of the travel drives of the two elevator cars.

The elevator installation according to the invention has a first operating mode and a second operating mode. In the first operating mode, at least two elevator cars which are capable of travel in a common shaft can travel in the shaft separately from one another wherein in said operating mode, said elevator cars can call at individually selectable starting and destination floors and have a relatively large spacing to one another. In the second operating mode of the elevator installation, the at least two elevator cars are coupled to one another by way of a variable-length, releasable coupling device. By way of the coupling device, it is ensured that, when the elevator cars travel one behind the other, the elevator car at the rear in the direction of travel exhibits practically the same braking deceleration as the elevator car at the front in the direction of travel. Therefore, in the second operating mode, the two elevator cars are capable of travel with a very small spacing to one another without the risk of collision.

In order that the vertical spacing of the coupled-together elevator cars can be adapted to different spacings between floors in a simple manner in terms of construction, use is made, in the case of the elevator installation according to the invention, of a variable length coupling device, with the aid of which the spacing between the coupled-together elevator cars can be varied. The variation in length requires no additional drive unit; rather, the variation in length may be realized by way of at least one of the travel drives of the coupled-together elevator cars.

To avoid the risk of a collision, a change in the vertical spacing between the elevator cars can be performed only if the relative speed of the coupled-together elevator cars satisfies at least one predefined criterion. The change in spacing is thus performed in a manner dependent on the relative speed of the two elevator cars. This ensures that, in the presence of low relative speeds, such as arise for example during an adaptation of the vertical spacing to different spacings between floors, a change in spacing can be performed by way of at least one of the travel drives of the coupled-together elevator cars, whereas in the case of a high relative speed between the coupled-together elevator cars, such as could arise for example in the event of a fault which causes the elevator car at the front in the direction of travel to brake abruptly, a change in spacing is blocked. Thus, despite the provision of a variable-length coupling device, a collision of the coupled-together elevator cars can be reliably prevented even in the event of a fault.

It may for example be provided that the spacing between the coupled-together elevator cars can be varied in the presence of relative speeds up to a predefined or predefinable maximum admissible relative speed. It is thus possible for a maximum admissible relative speed between the coupled-together elevator cars to be predefined or predefinable. In the presence of relative speeds up to the maximum admissible relative speed, it is possible for the vertical spacing between the elevator cars to be varied with the aid of at least one of the travel drives of the coupled-together elevator cars. In the presence of relative speeds above the maximum admissible relative speed, the coupling device can be blocked, such that its length cannot be varied, and consequently a change of spacing is also not possible.

As already mentioned, the spacing between two coupled-together elevator cars can be varied with the aid of at least one of the travel drives of the elevator cars. It is advantageous if the spacing between the coupled-together elevator cars can be varied, in a manner dependent on the relative speed between the elevator cars, with the aid of the travel drives of all of the coupled elevator cars.

For an increase of the spacing, it may for example be provided that the elevator car at the front in the direction of travel is, in the coupled state, with the aid of its travel drive, moved away from the elevator car at the rear in the direction of travel. For a decrease of the spacing, it may be provided that the elevator car at the rear in the direction of travel is, in the coupled state, with the aid of its travel drive, moved in the direction of the elevator car at the front in the direction of travel.

In an advantageous embodiment, the coupling device comprises at least one motorized coupling drive for establishing and releasing the coupling between the elevator cars. The motorized coupling drive may for example be an electric motor of relatively low electrical power, or may for example also be a hydraulic or pneumatic drive.

The elevator installation expediently comprises sensors which provide a signal corresponding to the relative speed of the elevator cars. As sensors, use may be made, for example, of decoders or rotational speed sensors, or for example also ultrasound sensors or position sensors, with the aid of which the position of the elevator cars in the shaft can be determined. From the changing position data, the speed of the elevator cars and also the relative speed of the elevator cars can be determined.

It is expediently the case that at least one sensor for determining the relative speed between the elevator cars is arranged in at least one elevator car.

The elevator cars are advantageously driven by way of supporting means, by way of which the elevator cars are connected to the travel drives. As supporting means, use may be made, in particular, of supporting cables.

It is expedient for the elevator cars to be connected by way of the supporting means to in each case one counterweight.

In a particularly preferred embodiment of the invention, the coupling device has at least one movable coupling member which is assigned an influencing member for influencing the movement of the coupling member in a manner dependent on the relative speed between the coupled-together elevator cars. For the variation of the vertical spacing between two coupled-together elevator cars, it is possible, in the case of such an embodiment of the invention, for the at least one coupling member to be moved relative to at least one of the elevator cars. The movement of the coupling member is performed in a manner dependent on the relative speed between the two elevator cars. This ensures that, in the event of a fault which gives rise to a high relative speed for example owing to an emergency stop of the elevator car at the front in the direction of travel, a collision of the elevator cars can be reliably prevented. For this purpose, the movement of the coupling member can be influenced, in particular braked or blocked, by the influencing member.

In particular, it may be provided that the speed of the coupling member relative to at least one of the two elevator cars can be limited by way of the influencing member. It is thus possible for a different speed to be provided for the coupling member in the presence of relatively high relative speeds than in the presence of relatively low relative speeds between the coupled-together elevator cars.

It is expedient if the coupling member can be arrested by way of the influencing member. This makes it possible, in the presence of relatively high relative speeds, for a movement of the coupling member, and thus also a change in the vertical spacing of the coupled-together elevator cars, to be prevented.

It is advantageously possible for tensile and compressive forces to be transmitted between the coupled-together elevator cars by way of the at least one coupling member.

It is particularly advantageous if the coupling device has multiple coupling members of identical design.

The coupling members are expediently arranged symmetrically with respect to a central axis of the elevator cars.

It may for example be provided that the elevator cars each have at least one coupling member on diametrically mutually opposite sides.

In an advantageous embodiment of the elevator installation according to the invention, the at least one coupling member has a hydraulic or pneumatic piston-cylinder assembly with a double-acting cylinder, and the influencing member is designed as a equalization device, wherein the ring-shaped chamber, surrounding a piston rod, of the piston-cylinder assembly can be connected to the piston chamber, arranged at the face side of a piston, of the piston-cylinder assembly by way of the equalization device in a manner dependent on the relative speed between the two coupled elevator cars. In the case of such an embodiment, the coupling member has a hydraulic or pneumatic cylinder in which a piston is arranged. A piston rod extends out of the cylinder proceeding from the piston. The interior space of the cylinder is divided by the piston into a ring-shaped chamber and a piston chamber. The ring-shaped chamber surrounds the piston rod, and the piston chamber is arranged at the face side of the piston. By way of an equalization device, a flow connection can be produced between the ring-shaped chamber and the piston chamber, wherein the flow connection is realized in a manner dependent on the relative speed between the two elevator cars that are connected to one another by way of the piston-cylinder assembly. Here, the hydraulic or pneumatic cylinder may be positioned on a first of the two elevator cars, and the piston rod may extend from the first elevator car to the second elevator car.

If the connection between the ring-shaped chamber and the piston chamber is opened up by the equalization device, a medium, for example compressed air or hydraulic oil, can flow from the ring-shaped chamber into the piston chamber, or in the opposite direction from the piston chamber into the ring-shaped chamber, for the purposes of varying the vertical spacing between the two elevator cars. If the connection is not opened up by the equalization device, the flow connection between the ring-shaped chamber and the piston chamber is shut off, and an exchange of medium is not possible, such that the piston cannot change its position in the cylinder. This in turn has the result that the vertical spacing between the elevator cars coupled together by way of the piston-cylinder assembly cannot be varied either.

In an advantageous embodiment, the equalization device has at least one throttling or blocking element which can be controlled in a manner dependent on the relative speed between the two elevator cars.

In particular, it may be provided that the equalization device has at least one electrically controllable throttle element.

With the aid of the at least one controllable throttle element, it is possible for the flow cross section of a connecting line between the ring-shaped chamber and the piston chamber to be varied in a manner dependent on the relative speed between the two elevator cars. For example, it may be provided that, in the presence of relatively low relative speeds, in particular in the presence of relative speeds up to a predefinable or predefined maximum admissible relative speed, a relatively large flow cross section is provided by the throttle element, whereas in the presence of high relative speeds, in particular if a predefinable or predefined maximum admissible relative speed is exceeded, the flow cross section is greatly reduced, in particular is reduced to a value of 0, such that the flow connection between the ring-shaped chamber and the piston chamber is shut off by way of the throttle element.

It may alternatively or additionally be provided that the equalization device has at least one hydraulically or pneumatically controllable shut-off element, for example a pressure-dependent closing valve. The controllable shut-off element, in particular the pressure-dependent closing valve, may be incorporated into the connecting line between the ring-shaped chamber and the piston chamber, and may shut off and open up the connecting line in a manner dependent on the relative speed between the two elevator cars. If the pressure-dependent closing valve is used, the connecting line can be shut off if the pressure in the connecting line upstream of the closing valve exceeds a predefined maximum admissible pressure value owing to an excessive relative speed between the two elevator cars.

It is expedient if the equalization arrangement has at least one pump. The pump forms a motorized coupling drive, with the aid of which, for example, a hydraulic medium can be pressurized in order to move the piston rod so as to establish and release the coupling between two elevator cars. The power of the pump may be relatively low, because it is used merely for establishing and releasing the coupling, not for varying the spacing between the elevator cars.

It may for example be provided that a first elevator car is arranged below a second elevator car, wherein at least one piston-cylinder assembly is arranged on the first elevator car. The ring-shaped chamber of the double-acting cylinder of the piston-cylinder assembly is connected by way of an equalization device to the piston chamber, and the equalization device has a pump with the aid of which the piston chamber can be charged with pressurized hydraulic fluid. This makes it possible for the piston rod to be moved in the direction of the second elevator car arranged above the first elevator car. On the free end of the piston rod there may be arranged first connecting elements, which interact with second connecting elements arranged on the second elevator car in order to establish coupling of the two elevator cars. By means of an arresting device arranged on the second elevator car, it is thus possible for the connecting elements to be arrested after coupling has taken place. If the coupling between the two elevator cars is to be released, it is possible for the arresting device, which is preferably of motorized form, to move the interacting connecting elements into a release position, and subsequently, the second elevator car arranged above the first elevator car can, with the aid of its travel drive, be moved upward in a direction away from the first elevator car.

In an advantageous embodiment of the invention, the at least one coupling member has a first mechanical coupling element and a second mechanical coupling element which can be placed in engagement with one another and are movable relative to one another, and the influencing member has at least one controllable brake element, wherein the relative movement of the two coupling elements can be braked and/or arrested with the aid of the brake element in a manner dependent on the relative speed between the coupled-together elevator cars.

It may for example be provided that the first mechanical coupling element is configured as a threaded spindle which is mounted, rotatably about its longitudinal axis, on a first of the couplable-together elevator cars and in that the second coupling element is configured as a threaded nut which is held on a second of the couplable-together elevator cars and which can be placed in engagement with the threaded spindle, wherein the threaded spindle can be limited in terms of its rotational speed and/or arrested by way of a controllable brake element in a manner dependent on the relative speed between the two elevator cars. In such an embodiment of the invention, the coupling of the two elevator cars is performed by way of at least one threaded spindle and a threaded nut which engages therewith. The threaded spindle is rotatable about its longitudinal axis, wherein the rotatability can be influenced with the aid of a controllable brake element. If the two elevator cars are moved relative to one another, the threaded spindle rotates, and thus the threaded nut moves along the threaded spindle, such that the vertical spacing between the two elevator cars changes. Such a change however takes place only in the presence of relatively low relative speeds, in particular in the presence of relative speeds below a predefined or predefinable maximum admissible relative speed. If the actual relative speed is greater than the maximum admissible relative speed, the brake element brakes the threaded spindle such that the latter is fully arrested, or can reach only a relatively low rotational speed.

It is expedient if the threaded spindle can be driven in rotation by way of a motorized coupling drive, in particular by way of an electric motor. This makes it possible for the coupling between the two elevator cars by way of the threaded rack and the threaded nut to be selectively established or released through activation of the motorized coupling drive. Furthermore, any self-locking action of the threaded spindle can be overcome by way of the motorized coupling drive.

It may also be provided that the first mechanical coupling element is configured as a toothed rack which is held on a first of the couplable-together elevator cars and in that the second mechanical coupling element is configured as a gearwheel which is rotatably mounted on a second of the couplable-together elevator cars and which can be placed in engagement with the toothed rack and which can be limited in terms of its rotational speed and/or arrested by way of a controllable brake element in a manner dependent on the relative speed between the two elevator cars. In such an embodiment of the invention, the coupling between a first elevator car and a second elevator car is performed with the aid of at least one toothed rack and a gearwheel which meshes with the toothed rack, which gearwheel can be braked and/or arrested with the aid of a brake element in a manner dependent on the relative speed between the two elevator cars. A variation of the vertical spacing between the first and the second elevator car can, in the presence of low relative speeds, be realized with the aid of the travel drives of the elevator cars, wherein the toothed rack and the gearwheel change their relative position. However, if a relatively high relative speed exists, in particular a relative speed higher than the maximum admissible relative speed, the rotational movement of the gearwheel is braked, and/or the gearwheel is arrested, such that at most a slow variation in spacing, or even no variation in spacing whatsoever, between the elevator cars is possible.

It may also be provided that the at least one coupling member has multiple mechanical coupling elements which are arranged on a first of the couplable-together elevator cars and which are connected movably to one another and which are releasably couplable to a second of the couplable-together elevator cars, wherein the coupling elements can be moved back and forth between a compact stowed position and coupling positions with different extents of deployment, and can be braked and/or arrested by way of the influencing member in a manner dependent on the relative speed between the two elevator cars. In the case of such an embodiment, the coupling of the two elevator cars is performed by way of the coupling elements, which can be deployed from a compact stowed position into coupling positions with different extents of deployment. The movement of the coupling elements is braked and/or arrested by the influencing member in a manner dependent on the relative speed between the two elevator cars.

The coupling elements may for example engage into one another in telescopic fashion. In the case of such an embodiment, in a compact stowed position, mutually directly adjacent coupling elements protrude into one another, and in coupling positions with different extents of deployment, the coupling elements are moved out from one another to a greater or lesser extent. The movement of the coupling elements relative to one another can be braked and/or arrested by the influencing member. Tensile and compressive forces can be transmitted between the two elevator cars via the arrested coupling elements. For the deployment and retraction of the coupling elements, the elevator cars can be caused to travel relative to one another with a low relative speed by way of their travel drives.

It is particularly advantageous if the mechanical coupling elements form a support chain and the influencing member is configured as a gearwheel which can be braked and/or arrested and which is in engagement with the support chain. The support chain has a multiplicity of coupling elements in the form of support chain members. In a compact stowed position, it is preferably the case that at least two sections of the support chain are arranged adjacent to or one above the other, wherein the support chain members of the individual sections are preferably oriented horizontally. In a deployed coupling position, at least some of the support chain members are lined up with one another and form a vertical support chain section by way of which two elevator cars can be coupled together. The influencing member is in the form of a gearwheel which is in engagement with the support chain and which can be braked and/or arrested. If the gearwheel is arrested, it is thus also the case that the support chain can no longer be moved, and compressive and tensile forces can be transmitted via the support chain from one of the two elevator cars to the other elevator car.

FIG. 1 schematically illustrates a first advantageous embodiment of an elevator installation according to the invention, which is denoted overall by the reference designation 10. The elevator installation 10 comprises an upper elevator car 12 and a lower elevator car 14, which are arranged one above the other in one shaft 16 and which are capable of travel upward and downward along common guide rails such as are known per se, which guide rails are therefore not illustrated in the drawing in order to give a better overview. The upper elevator car 12 is coupled to a first counterweight 20 by way of multiple first supporting cables, of which only one first supporting cable 18 is illustrated in the drawing in order to give a better overview. Correspondingly, the lower elevator car 14 is coupled to a second counterweight 24 by way of multiple second supporting cables, of which only one second supporting cable 22 is illustrated in the drawing in order to give a better overview.

The upper elevator car 12 is assigned a first travel drive 26. The first travel drive 26 has a first drive pulley 28 which, in a conventional manner which is therefore not illustrated in the drawing, can be set in rotation by a drive motor. The first supporting cables 18 are guided over the first drive pulley 28.

The lower elevator car 14 is assigned a second travel drive 30 with a second drive pulley 32, which can be set in rotation by a second drive motor such as is known per se, which second drive motor is therefore not illustrated in the drawing in order to give a better overview. The second supporting cables 22 are guided over the second drive pulley 32.

The invention will be discussed below on the basis of the example of the elevator installation 10 in which the elevator cars 12 and 14 are suspended on supporting cables 18, 22. The invention is, however, not restricted to such cable-type elevators, but rather also encompasses elevator installations whose elevator cars are moved by way of other travel drives, for example by way of linear drives.

In a first operating mode of the elevator installation, the two elevator cars 12 and 14 are capable of travel upward and downward in the shaft 16 separately from one another. In this operating mode, the elevator cars 12 and 14 have a safety spacing which ensures that, when the two elevator cars 12, 14 are traveling one behind the other, the elevator car at the rear in the direction of travel can be reliably braked without the risk of a collision even if the elevator car at the front in the direction of travel brakes abruptly in the event of a fault.

In a second operating mode of the elevator installation 10, the two elevator cars 12, 14 are coupled to one another by way of a variable-length, releasable coupling device 34. In the coupled state, the vertical spacing between the two elevator cars 12, 14 can be varied if the two elevator cars 12, 14 exhibit a relatively low relative speed with respect to one another. If the relative speed exceeds a predefined maximum admissible relative speed, a variation in spacing is no longer possible. This ensures that the two elevator cars 12, 14, in the coupled state, cannot collide with one another even if they have a very small spacing to one another.

The coupling device 34 comprises a first coupling member in the form of a first piston-cylinder assembly 36 and a second coupling member in the form of a second piston-cylinder assembly 38, which are arranged on mutually averted outer sides of the lower elevator car 14. The first piston-cylinder assembly has a first hydraulic cylinder 40 which is fixed to the lower elevator car 14 and in which a first piston 42 is mounted in displaceable fashion, from which piston a first piston rod 44 extends vertically upward. The first piston rod 44 projects out of the first hydraulic cylinder 40 in the direction of the upper elevator car 12 and can be connected to the upper elevator car 12 by way of a first releasable connecting device 46.

The interior space of the first hydraulic cylinder 40 is divided by the first piston 42 into a first ring-shaped chamber 48 and a first piston chamber 50. The first ring-shaped chamber 48 surrounds the first piston rod 44, and the first piston chamber 50 is arranged at that face side of the first piston 42 which is averted from the first piston rod 44.

The second piston-cylinder assembly 38 comprises a second hydraulic cylinder 52 which is fixed to the lower elevator car 14 and which receives a second piston 54 from which a second piston rod 56 extends in the direction of the upper elevator car 12, which second piston rod can be connected by way of its free end to the upper elevator car 12 by way of a second connecting device 58. The interior space of the second hydraulic cylinder 52 is divided by the second piston 54 into a second ring-shaped chamber 60 and a second piston chamber 62. The second ring-shaped chamber 60 surrounds the second piston rod 56 and the second piston chamber 62 is arranged at that face side of the second piston 54 which is averted from the second piston rod 56.

The first connecting device 46 and the second connecting device 58 each have an arresting member 64 or 66 respectively, which is movable by motor action and with the aid of which the connections between the piston rods 44, 56 and the upper elevator car 12 can be selectively arrested or released. The arresting members 64, 66 may for example be in the form of bolts which are movable by motor action. The bolts may be driven for example by way of electric motors or by way of pneumatic or hydraulic drives, or by electromagnetic means.

The ring-shaped chambers 48 and 60 of the two piston-cylinder assemblies 36, 38 are connected to one another by way of an equalization device 68. The equalization device 68 comprises a connecting line 70 which extends from the second ring-shaped chamber 60 to the second piston chamber 62 and to which there are connected a first attachment line 72, which proceeds from the first ring-shaped chamber 48, and a second attachment line 74, which proceeds from the first piston chamber 50. A first electrically controllable throttle element 76 and a second electrically controllable throttle element 78 are connected in series with one another in the first connecting line 70. A supply line 80 branches off from the first connecting line 70 between the two throttle elements 76, 78. A filter 82 is incorporated into the supply line 80. The supply line extends into the interior space of an equalization vessel 84 of the equalization device 68. The equalization vessel 84 forms a reservoir for hydraulic fluid.

A first pressure-dependent closing valve 88 is incorporated into the connecting line 70 in the region between the first throttle element 76 and the second ring-shaped chamber 60.

A second pressure-dependent closing valve 94 is incorporated into the connecting line 70 in the region between the second throttle element 78 and the second piston chamber 62. A check valve 96 and a motorized coupling drive in the form of a hydraulic pump 98 are incorporated in series with one another into a pump line 99, in parallel with respect to the second closing valve 94 and with respect to the second throttle element. The check valve 96 opens in the direction of the second piston chamber 62. The pump line 99 branches off from the connecting line 70 in the region between the second throttle element 78 and the second piston chamber 62, and opens into the equalization vessel 84.

The first ring-shaped chamber 48 and the second ring-shaped chamber 60 are thus connected to the first piston chamber 50 and to the second piston chamber 62 via the attachment lines 72, 74 and the connecting line 70. This makes it possible for the upper elevator car 12 to be moved relative to the lower elevator car 14 in the coupled state. For example, the lower elevator car 14 can be moved in the direction of the upper elevator car 12 in the coupled state with the aid of the second drive pulley 32. Here, the volume of the two piston chambers 50 and 62 decreases, and hydraulic fluid can flow via the attachment lines 72, 74 and the connecting line 70 from the piston chambers 50, 62 into the ring-shaped chambers 48 and 60. Here, the hydraulic fluid flows through the throttle elements 76 and 78 and the pressure-dependent closing valves 88, 94. Such equalization of hydraulic fluid between the piston chambers 50, 62 and the ring-shaped chambers 48, 60 is however possible only if the throttle elements 76, 78 open up a flow cross section of the connecting line 70 and the closing valves 88, 94 do not shut off the flow connection. This is the case if the two elevator cars 12, 14 have a relatively low relative speed with respect to one another. In the exemplary embodiment illustrated, for the determination of the relative speed, a sensor 100 is arranged on the base of the upper elevator car 12. Alternatively or in addition, it would also be possible for a sensor 102 to be arranged on the top of the lower elevator car 14. The sensor 100 measures the spacing between the two elevator cars 12, 14 and is connected, by way of a sensor line which is known per se and which is therefore not illustrated in the drawing in order to give a better overview, to a control device of the elevator installation 10, which is connected, by way of signal lines which are known per se and which are therefore not illustrated in the drawing in order to give a better overview, to the electrically controllable throttle elements 76, 78. From the changes in the relative spacings with respect to time, the control device determines the relative speed of the two elevator cars 12, 14 with respect to one another. If the relative speed exceeds a predefined or predefinable maximum admissible relative speed, the flow connection between the piston chambers 50, 62 and the ring-shaped chambers 48, 60 is shut off by way of the throttle elements 76, 78, whereas in the presence of relative speeds lower than the maximum admissible relative speed, said flow connection is opened up by the throttle elements 76, 78. Regardless of the electrical control of the throttle elements 76, 78, the closing valves 88, 94 shut off the connecting line 70 if the pressure in the ring-shaped chambers 48, 60 or in the piston chambers 50, 62 increases to an inadmissible extent owing to an abrupt change in spacing of the elevator cars 12, 14 and an associated abrupt movement of the pistons 42 and 54. In the presence of low relative speeds, it is thus possible for equalization of hydraulic fluid between the piston chambers 50, 62 and the ring-shaped chambers 48, 60 to take place, whereas in the presence of high relative speeds, such equalization of hydraulic fluids is not possible. In the presence of relative speeds above the maximum admissible relative speed, therefore, the two elevator cars 12, 14 are rigidly coupled to one another if the piston rods 44 and 56 are connected to the upper elevator car 12, and in the presence of low relative speeds, it is possible, in the coupled state of the two elevator cars 12, 14, for a variation of the vertical spacing between the two elevator cars 12, 14 to be performed. This makes it possible for the two elevator cars to travel in the shaft 16 with a small spacing to one another in the coupled state, wherein the vertical spacing between the two elevator cars 12, 14 can be adapted to different spacings between floors.

To produce the mechanical coupling between the lower elevator car 14 and the upper elevator car 12, the two elevator cars can firstly be positioned with a small spacing to one another by way of their travel drives 26, 28, and positioning of the piston rods 44 and 56 can subsequently be performed by way of the pump 98. It is then possible for the first piston rod 44 to be connected to the upper elevator car 12 by way of the first connecting device 46 and for the second piston rod 56 to be connected to the upper elevator car 12 by way of the second connecting device 58. The connection can subsequently be arrested by way of the arresting members 64, 66.

The elevator installation 10 thus makes it possible for the two elevator cars 12, 14 to travel in the shaft 16 selectively separately from one another or in a coupled state. In the coupled state, the vertical spacing between the two elevator cars 12, 14 can be varied by way of the travel drives 26 and 30 if the elevator cars 12, 14 assume a relatively low relative speed with respect to one another; otherwise, a variation in spacing is not possible.

Figure 2:
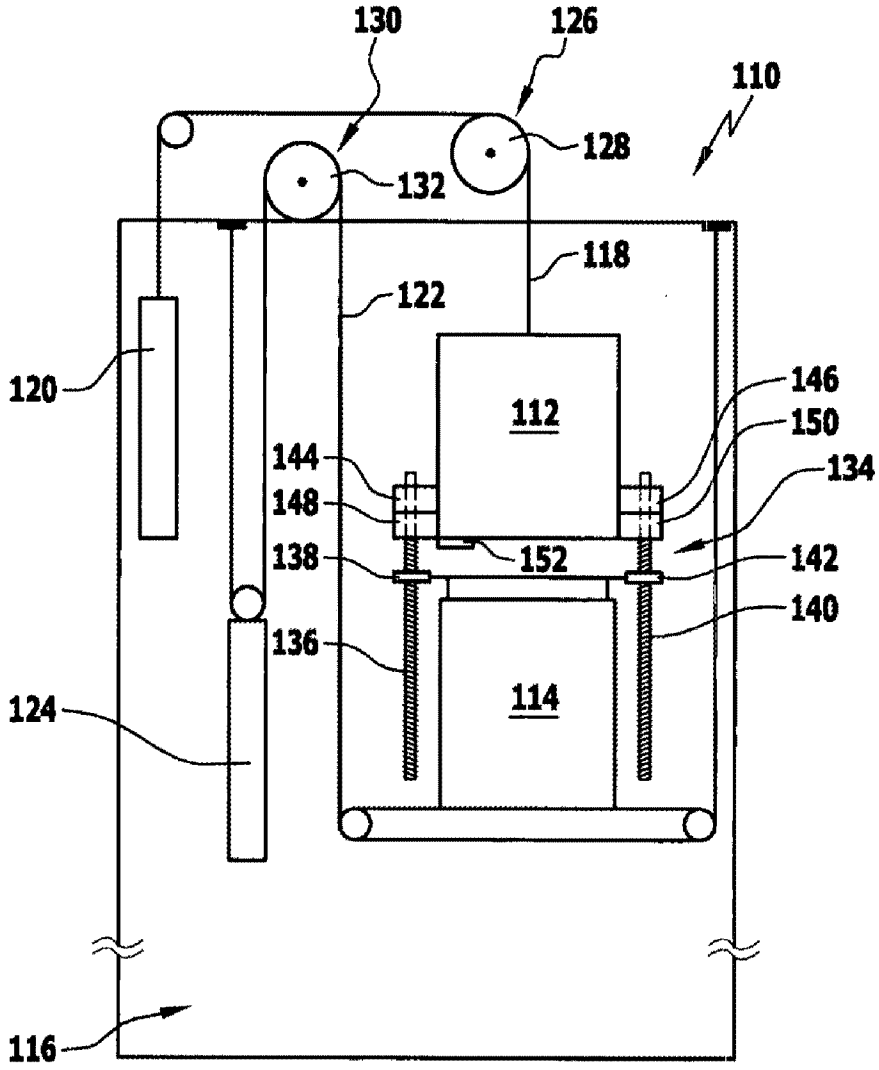
FIG. 2 is a schematic front view of an alternate embodiment of an elevator installation of the present disclosure.

FIG. 2 schematically illustrates a second advantageous embodiment of an elevator installation according to the invention, which is denoted overall by the reference designation 110. Correspondingly to the elevator installation 10 discussed above, the elevator installation 110 has an upper elevator car 112 and a lower elevator car 114 which are capable of travel upward and downward in a shaft 116. The upper elevator car 112 is connected to a first counterweight 120 by way of first supporting cables, of which only one first supporting cable 118 is illustrated in the drawing, and the lower elevator car 114 is connected to a second counterweight 124 by way of second supporting cables, of which only one second supporting cable 122 is illustrated in the drawing. The upper elevator car 112 is assigned a first travel drive 126 with a first drive pulley 128. The first supporting cables 118 are guided over the first drive pulley 128. The lower elevator car 114 is assigned a second travel drive 130 with a second drive pulley 132. The second supporting cables 122 are guided over the second drive pulley 132.

The elevator installation 110 has a coupling device 134 by way of which the two elevator cars 112, 114 can be coupled together. The coupling device 134 comprises a first coupling member which has a first mechanical coupling element in the form of a first threaded spindle 136 and a second mechanical coupling element in the form of a first threaded nut 138, which in the coupled state of the two elevator cars 112, 114 is in engagement with the first threaded spindle 136. Furthermore, the coupling device 134 has a second coupling member with a first mechanical coupling element in the form of a second threaded spindle 140 and with a second mechanical coupling element in the form of a second threaded nut 142, which in the coupled state of the two elevator cars 112, 114 is in engagement with the second threaded spindle 140. The two threaded spindles 136, 140 are rotatably mounted on mutually averted outer sides of the upper elevator car 112 and can be braked and arrested by way of a first brake element 144 and by way of a second brake element 146 respectively.

The first threaded nut 138 and the second threaded nut 142 are fixed to the lower elevator car 114. In order that the first threaded spindle 136 can be screwed into the first threaded nut 138 in order to establish coupling of the two elevator cars 112, 114, a first motorized coupling drive in the form of a first motor 148 is arranged on the upper elevator car 112. In order that the second threaded spindle 140 can be screwed into the second threaded nut 142 in order to establish coupling of the two elevator cars 112, 114, a second motorized coupling drive in the form of a second motor 150 is arranged on the upper elevator car 112. By means of the two motors 148, 150, the two threaded spindles 136, 140 can be set in rotation about their respective longitudinal axis. After the threaded spindles 136, 140 have been screwed into the threaded nuts 138, 142, it is possible for a self-locking action of the threaded spindles 136, 140 to be overcome by way of the two motors 148, 150, such that subsequently, during a relative movement of the two elevator cars 112, 114, the threaded spindles 136, 140 rotate about their longitudinal axis and can thereby move the threaded nuts 138, 142 along the threaded spindles 136, 140, wherein here, the vertical spacing between the upper elevator car 112 and the lower elevator car 114 changes. Thus, after coupling has taken place, a variation in spacing can be achieved in a simple manner with the aid of the travel drives 126, 130.

A variation in the vertical spacing between the elevator cars 112, 114 is performed only in the presence of relatively low relative speeds. For this purpose, the elevator installation 110 also comprises a sensor 152 arranged on the base of the upper elevator car 112. Alternatively or in addition, a sensor arranged on the top of the lower elevator car 114 may be used. The sensor 152 is, correspondingly to the sensor 100 discussed above with reference to FIG. 1, connected to a control device (not illustrated in the drawing) which controls the electrically controllable brake elements 144, 146 in a manner dependent on the relative speed between the two elevator cars 112, 114. If the relative speed exceeds a predefined maximum admissible relative speed, the two brake elements 144, 146 block a movement of the threaded spindles 136, 140, such that no variation in spacing can be performed and the two elevator cars 112, 114 are rigidly connected to one another. A change in spacing can be performed only if the actual relative speed determined by way of the sensors 152, 154 falls below the maximum admissible relative speed. Alternatively or in addition to the at least one spacing sensor 152, use may also be made of at least one rotational speed sensor which measures the rotational speed of the threaded spindle 136 or 140. In the presence of an inadmissibly high rotational speed, which corresponds to an inadmissibly high relative speed of the elevator cars 112, 114, the movement of the threaded spindles 136, 140 is blocked such that no further variation in spacing can be performed.

Figure 3:
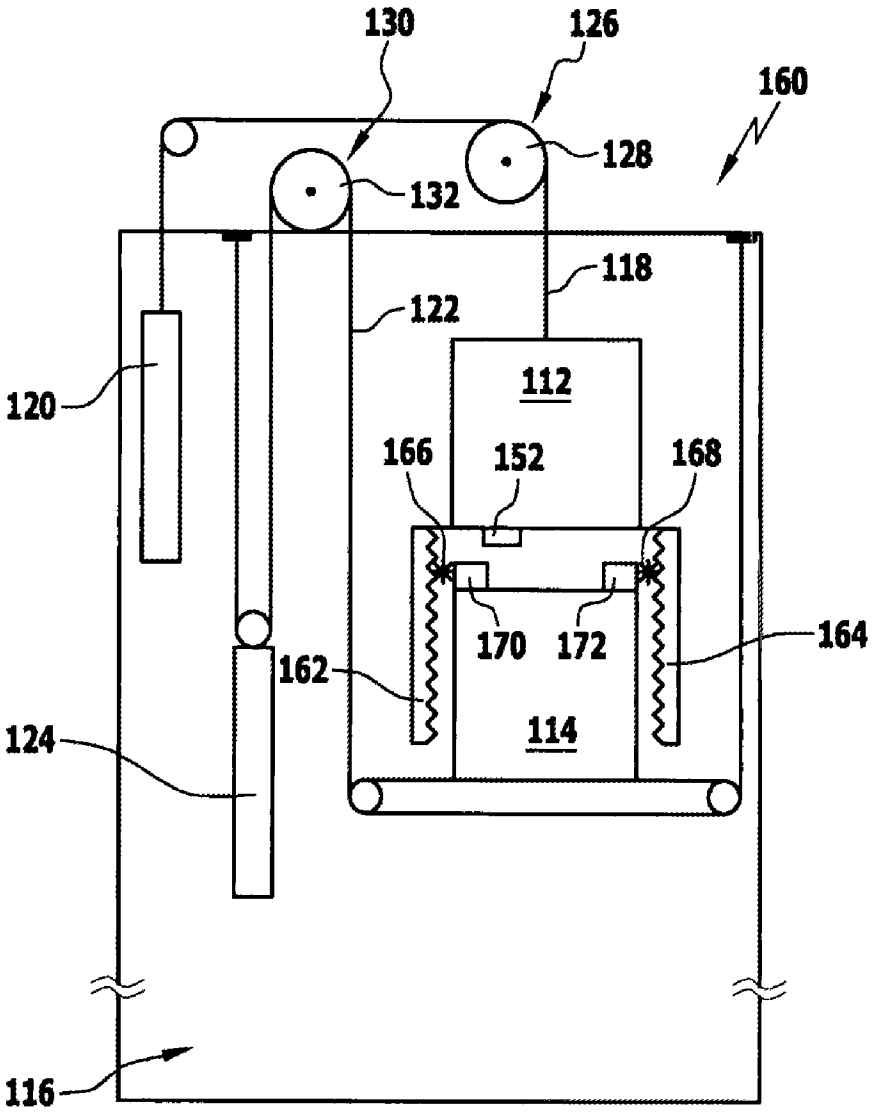
FIG. 3 is a schematic front view of an additional alternate embodiment of an elevator installation of the present disclosure.

FIG. 3 schematically shows a third advantageous embodiment of an elevator installation according to the invention, which is denoted overall by the reference designation 160. The elevator installation 160 is of substantially identical design to the elevator installation 110 presented above with reference to FIG. 2. Therefore, for identical components, the same reference designations as in FIG. 2 are used in FIG. 3, and with regard to said components, reference is made to the above explanations in order to avoid repetitions.

The elevator installation 160 illustrated in FIG. 3 differs from the elevator installation 110 discussed above in that the coupling of the upper elevator car 112 to the lower elevator car 114 is performed by way of a first toothed rack 162 arranged on the upper elevator car 112 and by way of a second toothed rack 164 which is likewise arranged on the upper elevator car 112, which toothed racks are in engagement with a first gearwheel 166 rotatably mounted on the lower elevator car 114 and with a second gearwheel 168 rotatably mounted on the lower elevator car 114. The first gearwheel 166 is assigned a first brake element 170 and the second gearwheel 168 is assigned a second brake element 172. By way of the brake elements 170, 172, the rotational movement of the gearwheels 166, 168 can be arrested if the relative speed between the upper elevator car 112 and the lower elevator car 114 exceeds a maximum admissible relative speed. For this purpose, the two brake elements 170, 172 are, correspondingly to the brake elements 144, 146 discussed above with reference to FIG. 2, electrically connected to a control device (not illustrated in the drawing) of the elevator installation 160, which control device is in turn coupled to at least one sensor, with the aid of which the relative speed of the two elevator cars 112, 114 can be determined. In FIG. 3, in order to give a better overview, motors which each form a coupling drive and which move the toothed racks 162, 164 into their coupling position are not illustrated.

It is thus possible, below the maximum admissible relative speed, in the coupled state of the two elevator cars 112, 114, for the vertical spacing thereof to be varied in a simple manner by way of the travel drives 126, 130. However, if the actual relative speed exceeds the maximum admissible relative speed, the gearwheels 166, 168 are arrested such that the two elevator cars 112, 114 are rigidly coupled to one another by way of the toothed racks 162, 164 and the arrested gearwheels 166, 168. Alternatively or in addition to the at least one sensor 152, it would also be possible, for the determination of the relative speed of the elevator cars 112, 114, for the rotational speed of the gearwheels 166, 168 to be measured.

Figure 4:
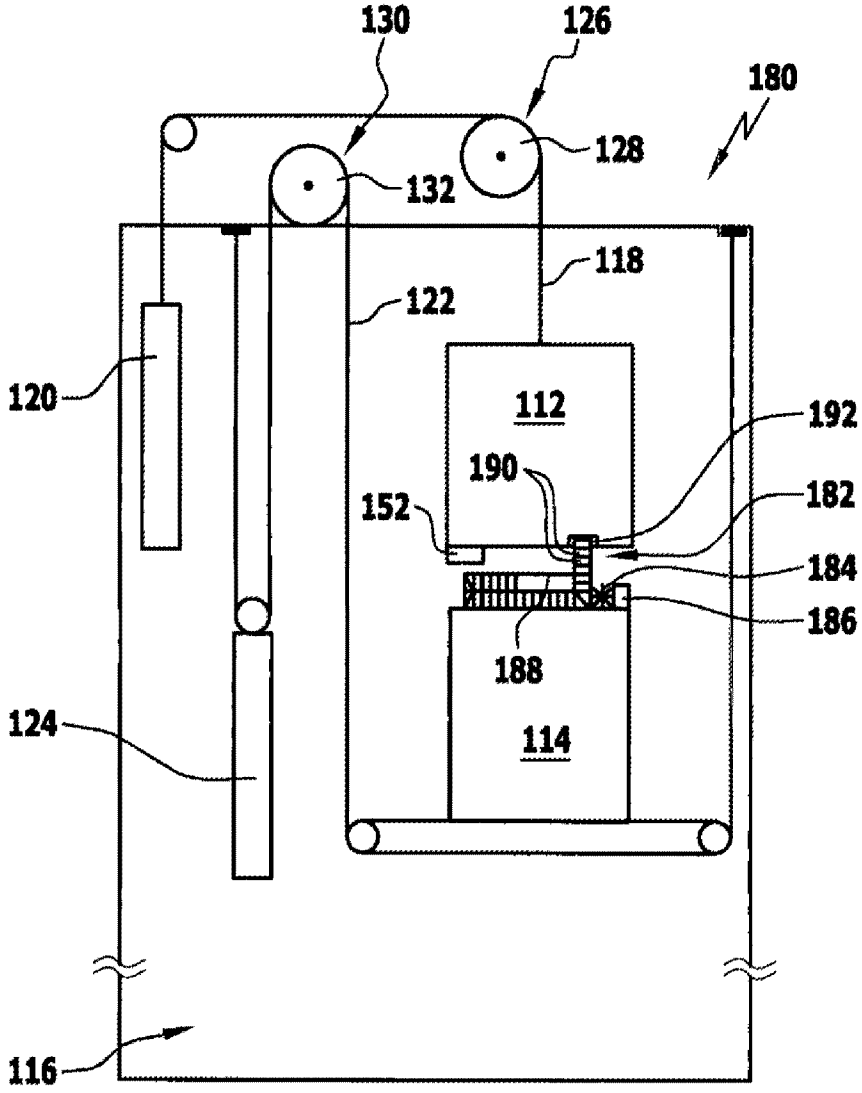
FIG. 4 is a schematic front view of an additional alternate embodiment of an elevator installation of the present disclosure.

FIG. 4 schematically illustrates a fourth advantageous embodiment of an elevator installation according to the invention, which is denoted overall by the reference designation 180. The elevator installation 180 is of substantially identical design to the elevator installation 110 presented above with reference to FIG. 2. Therefore, for identical components, the same reference designations as in FIG. 2 are used in FIG. 4, and with regard to said components, reference is made to the above explanations in order to avoid repetitions.

In the case of the elevator installation 180 illustrated in FIG. 4, the coupling between the upper elevator car 112 and the lower elevator car 114 is realized by way of a multiplicity of mechanical coupling elements which form a support chain 182. The support chain 182 is positioned on the lower elevator car 114 and can, by way of a coupling drive which is not illustrated in FIG. 4 in order to give a better overview, be moved back and forth between a compact stowed position and coupling positions with different extents of deployment. In the stowed position, the support chain 182 protrudes almost entirely into a support chain housing 188, wherein the support chain members 190 are, for the most part, arranged horizontally adjacent one another and an upper support chain section is positioned above a lower support chain section. From the compact stowed position, the support chain 182 can be moved into a deployed coupling position illustrated in FIG. 4, in which it projects partially out of the support chain housing 188 in a vertical direction, wherein a multiplicity of support chain members 190 are arranged vertically one above the other.

An influencing member in the form of a gearwheel 184 is in engagement with the support chain 182. The gearwheel 184, which is arranged on the lower elevator car 114, can be braked and arrested by a controllable brake element 186. A free end of the support chain 182 can be fixed by way of a connecting device 192 to the upper elevator car 112 in order to couple the two elevator cars 112, 114 together. The connecting device 192 may, for this purpose, have connecting elements which interact with one another, and additionally, a controllable arresting member may be used, with the aid of which the connecting elements can be arrested. Such connecting elements and arresting members are known per se to a person skilled in the art and therefore do not require any further explanation here. In the coupled state, the vertical spacing of the two elevator cars 112, 114 can be varied in a simple manner with the aid of the two travel drives 126, 130 if the relative speed between the two elevator cars 112, 114 does not exceed a maximum admissible relative speed. If such a low relative speed exists, the movement of the gearwheel 184 is not impeded by the brake element 186, such that, by way of a relative movement of the two elevator cars 112, 114, the spacing thereof to one another can be varied. However, if the relative speed exceeds the maximum admissible relative speed, the gearwheel 184 is braked and arrested by way of the brake element 186. Rigid coupling then exists between the upper elevator car 112 and the lower elevator car 114, wherein compressive forces in particular can be transmitted between the two elevator cars 112, 114 via the support chain 182.

In the case of the elevator installation 180, too, it is thus the case that, in a first operating mode of the elevator installation 180, the elevator cars 112, 114 are capable of travel in the shaft 116 separately from one another, wherein the elevator cars have a safety spacing to one another which ensures that, when the two elevator cars 112, 114 are traveling one behind the other, the elevator car at the rear in the direction of travel can be reliably braked without the risk of a collision even if the elevator car at the front in the direction of travel brakes abruptly in the event of a fault. If the two elevator cars 112, 114 have a small spacing to one another, they can, in a second operating mode of the elevator installation 180, be coupled together by way of the support chain 182, the gearwheel 184 and the brake element 186, wherein, in the presence of low relative speeds, the relative spacing of said elevator cars can be varied by way of the travel drives 126, 130 in order to adapt the vertical spacing of the elevator cars 112, 114 to different spacings between floors. For the variation in spacing, the support chain 182 can be moved back and forth between its compact stowed position and coupling positions with different extents of deployment. In the presence of high relative speeds such as may arise in the event of a fault which causes the elevator car at the front in the direction of travel to brake abruptly, the support chain 182 is arrested such that it cannot be varied in length, and consequently the elevator cars 112, 114 cannot collide with one another.

The invention claimed is:

1. An elevator installation, comprising:

an elevator shaft;

at least a first elevator car and a second elevator car disposed in said shaft and arranged one above the other, and separately moveable from one another in an upward and downward vertical direction;

a first travel drive assigned to and operatively engaged with said first elevator car, and configured to provide traveling movement to said first elevator car;

a second travel drive assigned to and operatively engaged with said second elevator car, and configured to provide traveling movement to said second elevator car; and a variable-length releasable coupling device configured to:

selectively couple said first elevator car to said second elevator car, permit one of said first or second travel drives to variably adjust a spacing between the coupled-together first and second elevator cars as long as a relative speed between said first and second elevator cars is maintained below a predefined maximum relative speed, and prevent a further change in spacing between the coupled-together first and second elevator cars when said relative speed exceeds said predefined maximum relative speed.

2. The elevator installation of claim 1, wherein said variable-length releasable coupling device comprises:

at least one moveable coupling member, and an influencing member in operative communication with said at least one moveable coupling member and configured to influence a movement of said moveable coupling member with respect to said influencing member, as long as the relative speed between the coupled-together first and second elevator cars is maintained below the predefined maximum relative speed.

3. The elevator installation of claim 2, wherein said influencing member is an equalization device, and wherein said at least one moveable coupling member comprises one of a hydraulic or pneumatic piston-cylinder assembly, said piston-cylinder assembly having:

a double-acting cylinder defining a ring shaped chamber and a piston chamber therein, and a piston fixed to a piston rod that is moveable in said ring-shaped chamber of said double-acting cylinder, wherein said ring shaped chamber and said piston chamber may be operatively coupled together by said equalization device in a manner dependent on the relative speed between the coupled-together first and second elevator cars.

4. The elevator installation of claim 3, wherein said equalization device comprises a throttling element configured to be controlled based on the relative speed between the coupled-together first and second elevator cars.

5. The elevator installation of claim 3, wherein said equalization device comprises at least one pump.

6. The elevator installation of claim 2, wherein said at least one moveable coupling member comprises a first mechanical coupling element and a second mechanical coupling element that can be engaged with, and are moveable relative to, one another, wherein said influencing member comprises at least one controllable brake element, and wherein a relative movement of said first and second mechanical coupling elements can be arrested by said at least one controllable brake element based on the relative speed between said first and second elevator cars.

7. The elevator installation of claim 6, wherein said first mechanical coupling element is a threaded spindle that is rotatably mounted about its longitudinal axis on said first elevator car, wherein said second mechanical coupling element is a threaded nut fixed onto said second elevator car and which can be engaged with said threaded spindle, and wherein a rotational speed of said threaded spindle can be limited by way of said at least one controllable break element based on the relative speed between said first and second elevator cars.

8. The elevator installation of claim 6, wherein said first mechanical coupling element is a toothed rack that is fixed to said first elevator car, and wherein said second mechanical coupling element is a gearwheel that is rotatably mounted on said second elevator car and is engaged with said toothed rack, a rotational speed of said gear wheel being limited by way of said at least one controllable brake element based on the relative speed between said first and second elevator cars.

9. The elevator installation of claim 2, wherein said at least one moveable coupling member comprises a plurality of mechanical coupling elements disposed on said first elevator car and moveably connected to one another, and which mechanical coupling elements are releasably couplable to said second elevator car, wherein said plurality of mechanical coupling elements are moveable between a compact stowed position and a plurality of coupling positions having varying extents of deployment, said plurality of mechanical coupling elements further being arrestable by way of said influencing member based on the relative speed between said first and second elevator cars.

10. The elevator installation of claim 9, wherein said plurality of mechanical coupling elements form a support chain, and wherein said influencing member is a gearwheel that is engaged with said support chain and can be arrested.

11. The elevator installation of claim 1, wherein the spacing between the coupled-together elevator cars can be varied, based on the relative speed between the first and second elevator cars, with the aid of the travel drives of all of the coupled elevator cars.

12. The elevator installation of claim 1, wherein said coupling device comprises at least one motorized coupling drive configured to couple and decouple said first and second elevator cars together.

13. The elevator installation of claim 1, wherein said first and second elevator cars are respectively connected to said first and second travel drives by supporting means.

14. The elevator installation of claim 1, wherein said first and second elevator cars are connected to a respective counterweight by supporting means.

15. The elevator installation of claim 2, wherein said influencing member is configured to limit a speed of said coupling member.

16. The elevator installation of claim 2, wherein said influencing member is configured to arrest said coupling member.

17. The elevator installation of claim 2, wherein said coupling member is configured to transmit at least one of tensile and compressive forces between the coupled-together elevator cars.

18. The elevator installation of claim 2, wherein said coupling device comprises a plurality of coupling members of identical design.

* * * * *